United States Patent [19]

Richards

[11] Patent Number: 4,876,745

[45] Date of Patent: Oct. 31, 1989

[54] KNEE PADS

[76] Inventor: Lee E. Richards, 1681 Devine Rd., North Whitfield, Me. 04253

[21] Appl. No.: 192,912

[22] Filed: May 12, 1988

[51] Int. Cl.[4] ..... A41D 13/00

[52] U.S. Cl. ..... 2/24; 297/423

[58] Field of Search ..... 2/24, 22, 23, 16, 62; 128/165; 297/423

[56] References Cited

U.S. PATENT DOCUMENTS

| | | | |
|---|---|---|---|
| 833,546 | 10/1906 | Pierce | 2/22 |
| 1,571,088 | 1/1920 | Buchanan | 2/24 |
| 3,025,526 | 3/1962 | Ramon | 2/24 |
| 4,633,529 | 1/1987 | Litz | 2/24 |
| 4,772,071 | 9/1988 | Richards | 2/24 X |

FOREIGN PATENT DOCUMENTS

| | | | |
|---|---|---|---|
| 843232 | 7/1952 | Fed. Rep. of Germany | 2/24 |

*Primary Examiner*—Ronald Feldbaum

[57] ABSTRACT

A knee pad has a flat bottomed support dimensioned to underlie the kneecap and a substantial adjacent length of the tibia. The support has a cushioned concavity for the knee and a channel for the lower leg which is inclined upwardly away from the plane of the flat bottom and towards the foot. The channel terminates in a fork disposed to straddle the instep of the shoe on that foot. The depth of the concavity is such that at least the greater part of the wearer's weight is borne by the tibia. The knee pad has a cuff of hard surfaced but flexible material by which it is detachably secured to a lower leg and fitted against the calf thereof. Both that portion of the support which is to underlie the knee and the forked end of the channel may have sections which may flex.

19 Claims, 7 Drawing Sheets

27A
27
27C
27B
29D
29
29B
29A
29C
28A
28

13
10
21
11
12

26
25
24A
17
28
27C
27
24
24B
29
29B
29A
20
25
23
19

KNEE PADS

BACKGROUND OF THE INVENTION

For those who must work in a kneeling position, knee pads are a necessity.

While the ideal knee pad provides that the weight of the wearer will be transmitted directly to the surface on which the user is kneeling, see my co-pending application Ser. No. 40,046, filed Apr. 16, 1987, such knee pads are relatively expensive when compared to typical knee pads which only cushion the knees and are held in place by pairs of straps. Such straps, if tight enough to hold the knee pads in place during use, are usually a cause of discomfort.

THE PRESENT INVENTION

The general objective of the present invention is to provide knee pads which, without requiring the use of buttocks supports substantially free the knees from the wearer's weight while in kneeling positions.

In accordance with the invention, this objective is attained with a knee pad having a flat bottomed support underlying a concavity for the knee cap and a substantial adjacent length of the tibia, the support also has a leg-receiving channel inclined upwardly away from the plane of the flat bottom and towards the foot and extending beyond the support and terminating adjacent the instep of the shoe on that foot in a manner permitting the flexing thereof. The depth of the concavity is such that the thickness of the cushioning material is enough greater than that on which the lower leg rests so that the weight of the wearer is primarily borne by the portion of the lower leg overlying the support.

Knee pads in accordance with the invention, due to the taper of a lower leg caused by its calf and the necessity of avoiding straps in contact with the leg, are provided with cuffs of a flexible, hard surfaced material between the flat bottomed support and the free end of the channel. Each cuff has first and second end portions. The first end portion is shaped and dimensioned to be wrapped about the lower leg and dimensioned to fit against substantially the entire length of the downwardly tapering portion of the calf and the second end portion of the cuff is shaped and dimensioned to overlie the first cuff portion, pulled to fit the first portion against the calf, and then releasably anchored. The thus fitted knee pad is prevented from movement relative to the lower leg by the supporting engagement of the lower or free end of the knee pad with the instep of the footwear being worn.

The snug fitting of the knee pad to the lower leg can be attained by offsetting the effect of the thickest part of the calf as by means of a protuberance on or attached to the channel adjacent its free end. In practice, an obtuse angular relationship is required between the first and second end portions of the cuff and the use of such a protuberance can be avoided by suitably decreasing the angle between the end portions of the cuff.

Another important objective of the invention is to enable such knee pads to be sufficiently flexible to ensure maximum comfort in use.

To that end, the portion of the support underlying the knee-receiving concavity has upper and lower sections interconnected in a manner enabling them to be flexed relative to a transverse hinge line. This objective is also attained with respect to the lower end of the channel by enabling the lower end to be flexed along transverse lines.

Other objectives of the invention and the manner in which they are attained will be apparent from the following description of a preferred embodiment and the appended claims.

BRIEF DESCRIPTION OF THE DRAWINGS

The accompanying drawings illustrate a preferred embodiment of the invention of which

THE PREFERRED EMBODIMENT OF THE INVENTION

Figure 1:
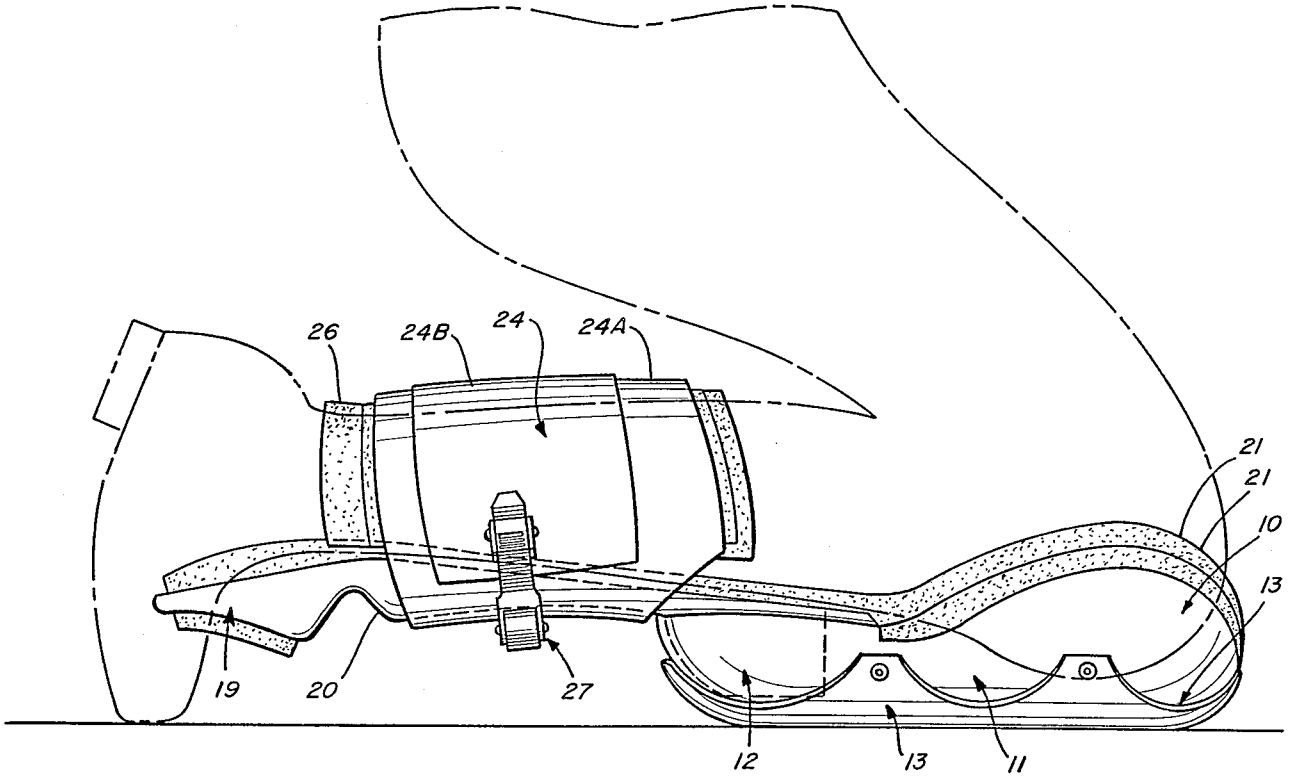
FIG. 1 is a side view of the knee pad attached to the lower leg of a person in a kneeling position.

The knee pad illustrated by the drawings has a flat bottomed support, generally indicated at 10, which includes an upper or forward section 11 and a lower section 12. The flat bottom is covered by a non-slip, non-marring layer 13 having sides and ends anchored to the sides and ends of the support 10. Three-ply polynitrate is a satisfactory material for that purpose.

The inner surface of the upper section 11 is a concavity 14 which is shaped and dimensioned to accommodate the knee cap and an adjacent portion of the tibia. The inner surface of the lower section 12 of the support establishes a seat 15 which is arcuate in cross section and inclined away from the plane of the flat bottom and from the concavity. It will be noted that the sections 11 and 12 are separated by a transverse shoulder 16 exposed in the concavity 14. The seat 15 is of sufficient length to underlie a substantial lengthwise portion of the tibia.

A channel 17 receptive of the lower leg has its upper end anchored to the seat 15 by screws 18 and its lower end is shown as terminating in an outwardly flared fork 19 shaped and dimensioned to straddle the shoe on the wearer's foot and permit it to be flexed in a normal manner. Adjacent the fork 19, the channel 17 has an underlying protuberance 20 which tapers downwardly and outwardly towards the fork as an offset to the calf.

The cavity 14 has a first layer 21 of cushioning material, felt for one example, which fills it to the level of the shoulder 16 and a second like layer which fills the cavity to the level of the proximate one of the series of cushioning layers 21, 22 and 23 which line the channel 17. The cushioning layer 23 extends beyond the free end of the channel to engage or be engaged by the shoe. As each knee pad is to accommodate a kneecap and extend to the ankle of the wearer, it is the practice, if the knee pads are made in but one size, to have the knee pads of a predetermined maximum length with the channel 17 cut back to have the knee pad of the correct length for a particular user before boring the holes in its upper end for the screws by which the channel is secured to the support 10.

Figure 6:
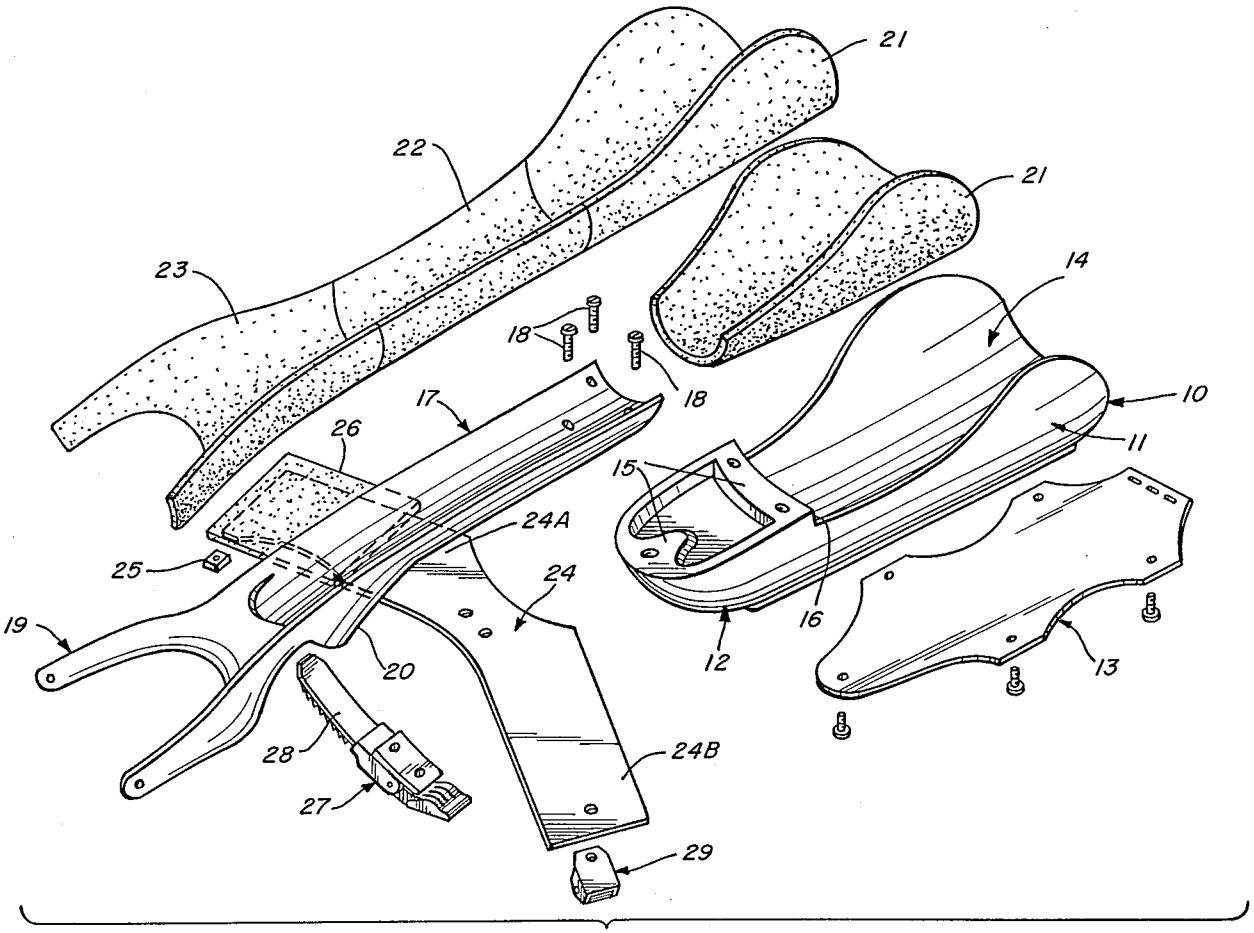
FIG. 6 is an exploded view of the knee pad components.

In order to attach the knee pad to a lower leg of the wearer, a cuff generally indicated at 24, of a flexible, hard surfaced material such as a high density polyethylene, has its central portion connected to the channel 17 between the protuberance 20 and the support 10. The end portions 24A and 24B have an obtuse angular relationship as will be apparent from FIG. 6. Such a relationship is shown for the purpose of illustrating a general requirement that when the end portion 24A is wrapped about the calf, it will fit against the downwardly tapering length thereof as the end portion 24B is pulled over the end portion 24A between its guides 25 in a manner drawing the layer of cushioning material 26 with which the end portion 24A is provided snugly against the calf. The end portion 24B is then releasably locked against movement by means next to be described.

Figures 2, 7:
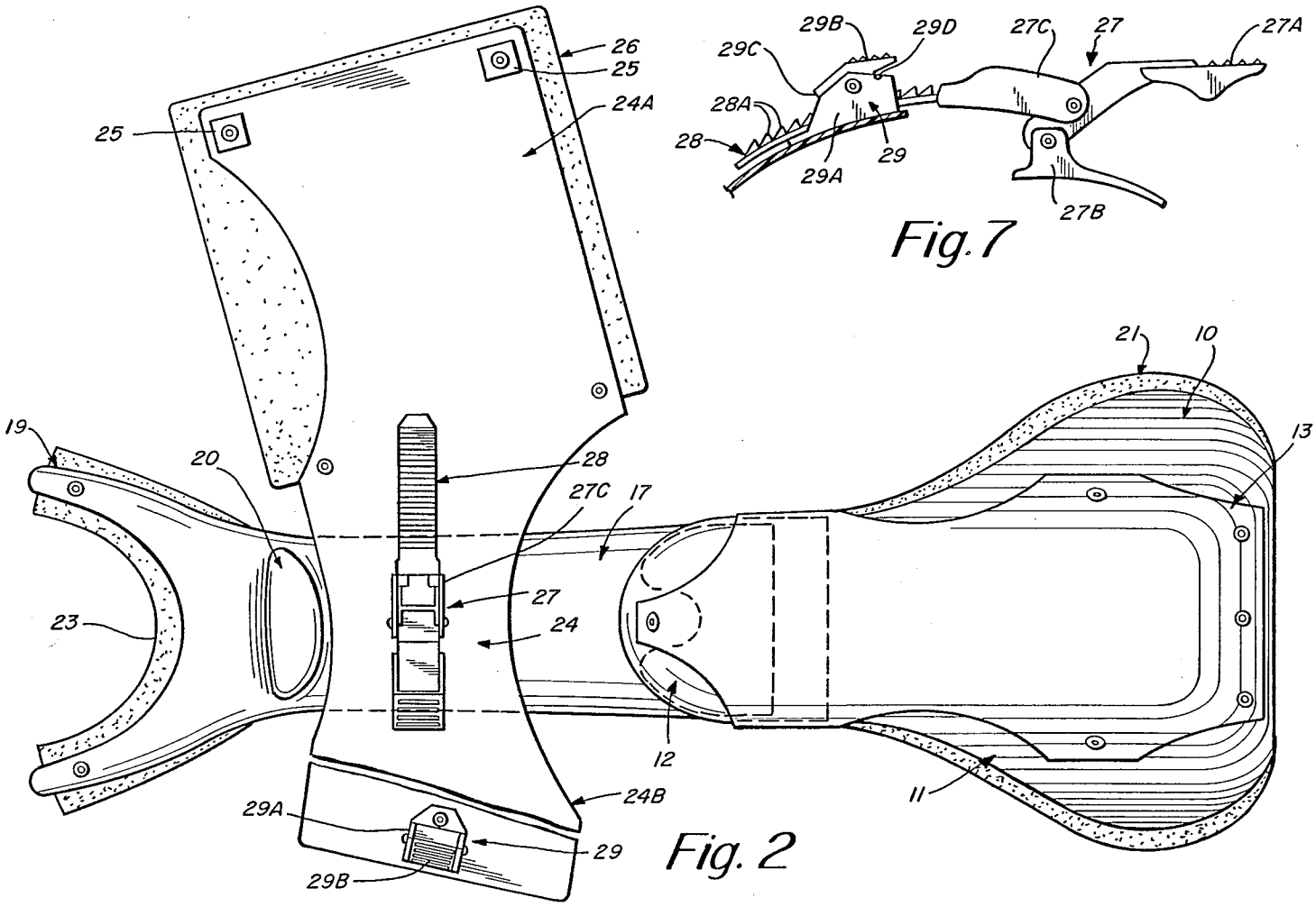
FIG. 2 is a plan view of the knee pad as seen from its undersurface.
FIG. 7 is a side view of a device suitable for use in securing the cuff when fitted to the leg.
Figure 3:
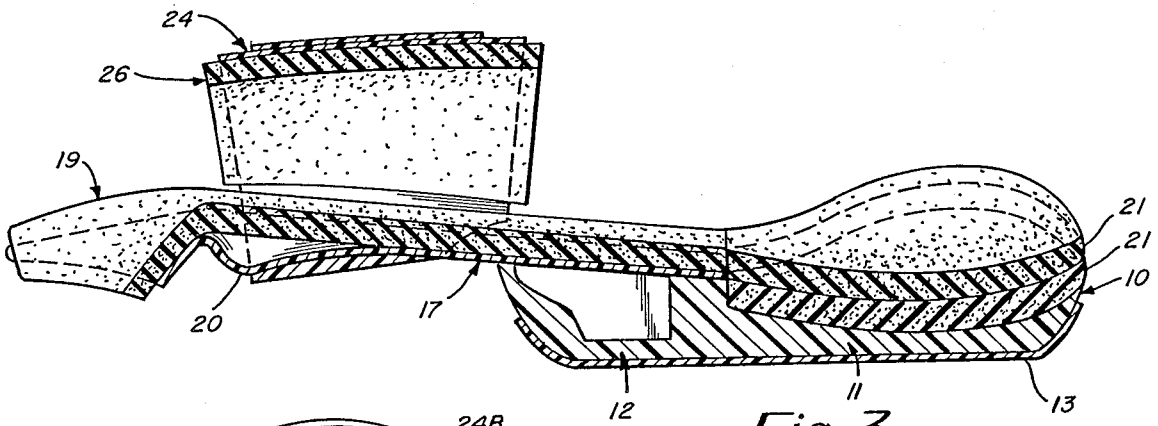
FIG. 3 is a section taken lengthwise of the knee pad
Figure 4:
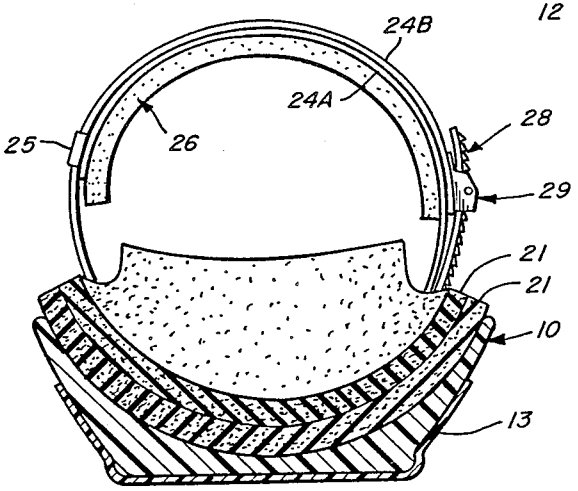
FIG. 4 is a transverse section of the knee pad taken through the flat bottomed support.

Reference is made to FIG. 7 wherein a toggle joint, generally indicated at 27, is shown having an operating lever 27A pivotally connected at one end to a mount 27B which is anchored to the central portion of the cuff 24, see FIG. 2. A link 27C is pivotally connected to an intermediate part of the lever 27A and is provided with the strap 28 shown as having transverse shoulders 28A.

A latch, generally indicated at 29, has its base 29A attached to the end portion 24B of the cuff close to its free end. A catch 29B is pivotally connected to the base 29A and is biased by the spring 29D to bring its locking end 29C into its operative position against the trailing margin of the base. The catch 29B is opened by manually depressing the other end thereof to enable the free end of the strap 28 to be passed through the latch and exposed and pulled until the end portions of the cuff have been fitted about the leg with the catch locking the strap against movement. During the fitting the cuff 24 to the leg, the toggle joint is open and when the strap 28 has been pulled to fit the cuff to the leg, the toggle joint is closed to effect a snug fit of the cuff.

Figure 5:
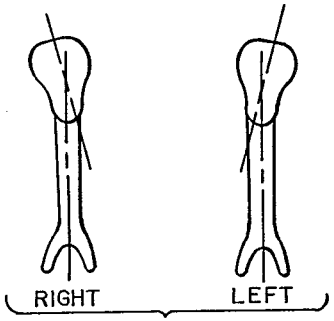
FIG. 5 is a somewhat schematic view of a modified form of the invention in which there are right and left knee pads.

As illustrated by FIG. 5, the knee pads may be made in pairs differing only in that the long axes of the concavities of each pair inclined slightly towards each other.

Figure 9:
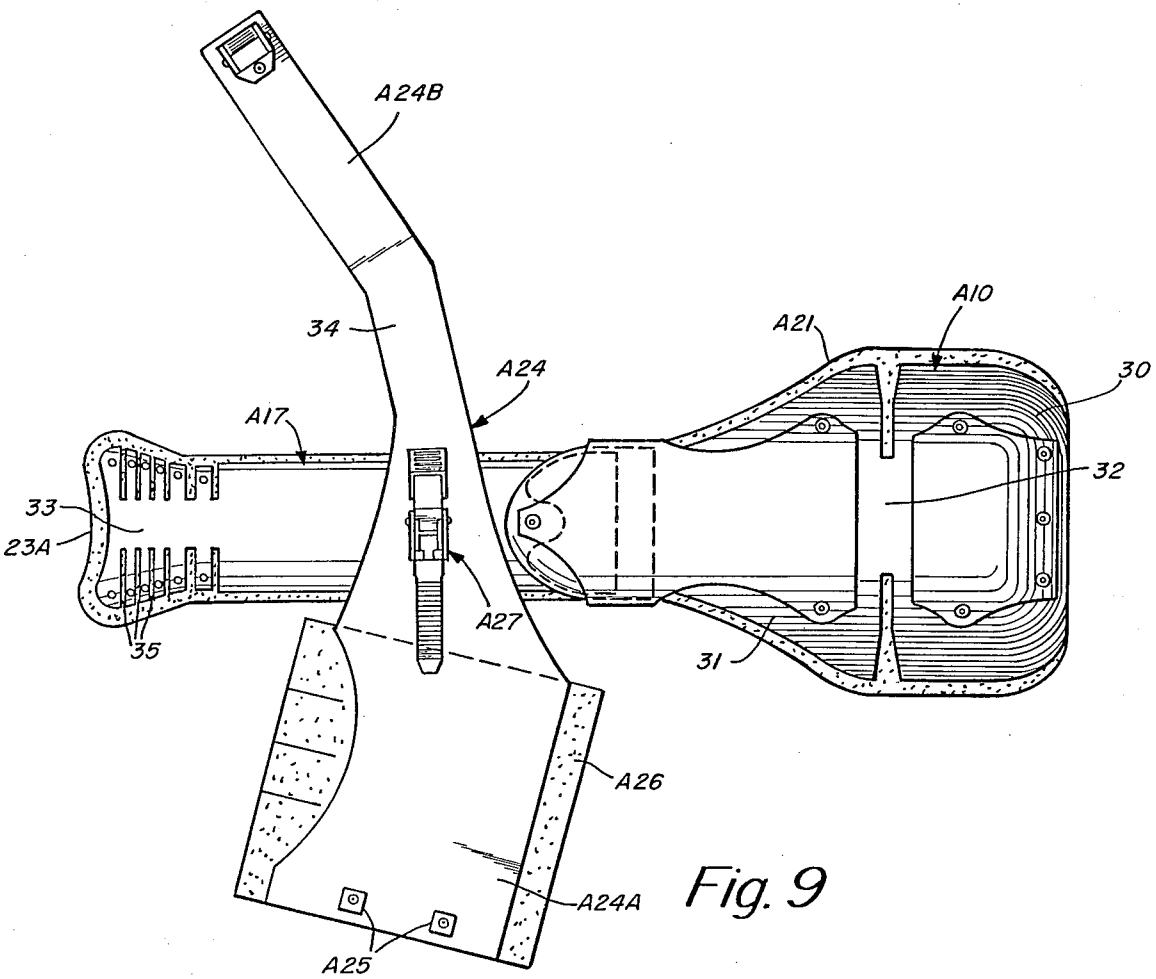
FIG. 9 is a bottom plan view of the knee pad of FIG 7.
Figure 8:
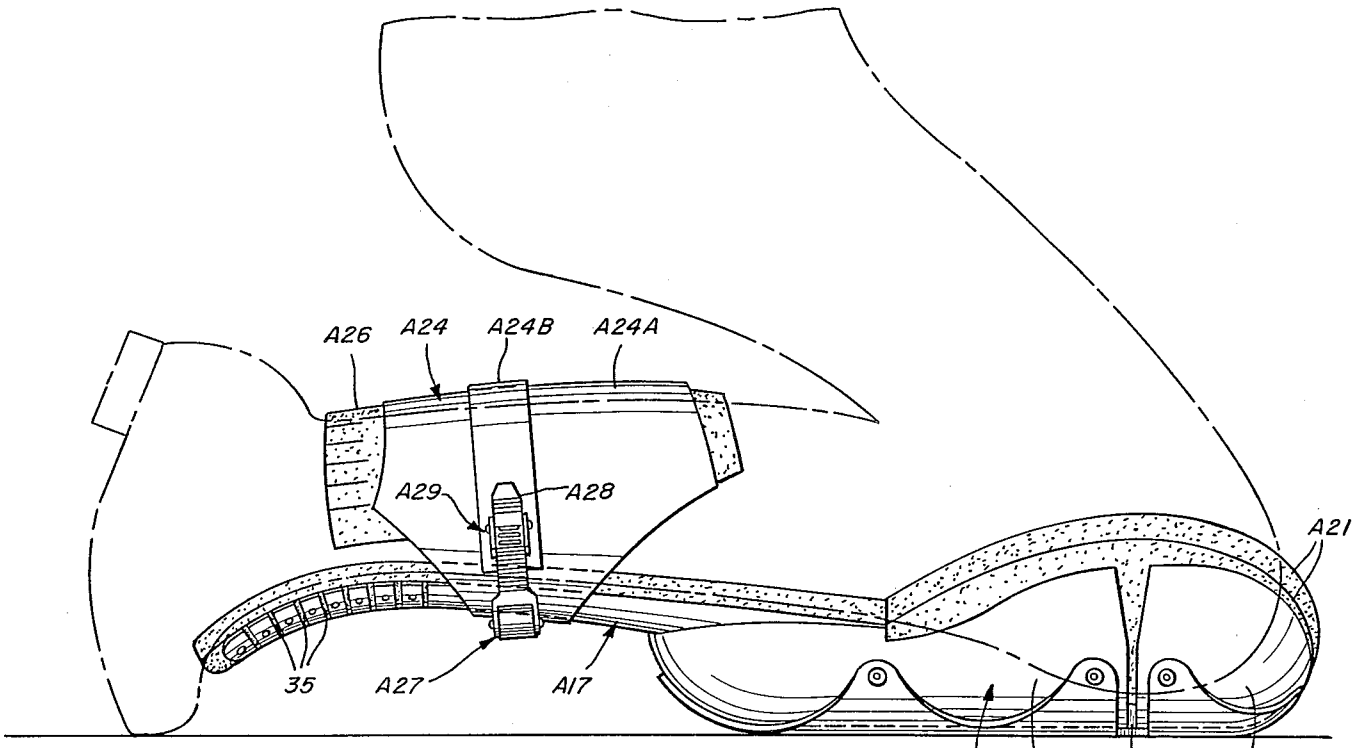
FIG. 8 is a view, similar to FIG. 1, illustrating another embodiment of the invention.
Figure 10:
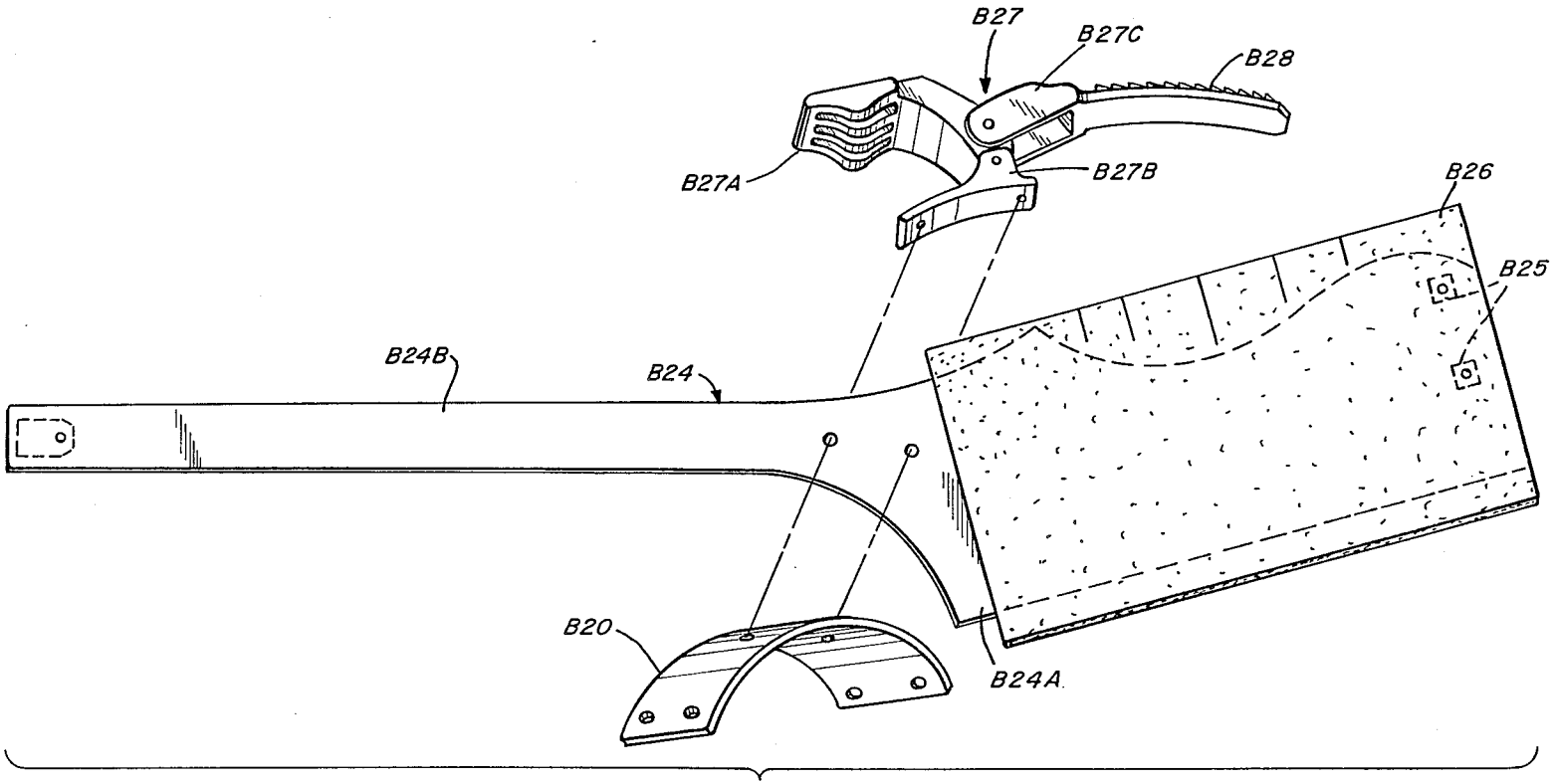
FIG. 10 is an exploded view of a cuff in accordance with another embodiment of the invention.

The embodiment of the invention illustrated by FIGS. 8–10 is generally similar to that previously described and hence will not again be detailed except for important structural differences. Corresponding parts, however, are identified by the same reference numerals which are distinguished by the prefix addition "A".

An important feature of the support A10 is that it consists of upper and lower sections 30 and 31 interconnected at 32 which is a web if the support A10 is molded from a plastic such as to permit the connecting web to be flexible. The adjacent margins of the sections 29 and 30 are shown as diverging to an extent permitting the sections to flex to the wanted extent during use. The sections 30 and 31 are each provided with a layer of three ply polynitrate.

Another important feature illustrated by FIGS. 8–10 is that the lower end of the channel A17 includes a series of transversely aligned slots 35 separated by a web 33. The lower end of the channel A17 is thus sufficiently flexible that the the exposed cushioning layer 23A may engage the instep of the shoe and flex freely in response to foot movements.

Another feature of the knee pad A10 is that the cuff A24 has its end portion A24A disposed at an angle relative to transversely positioned toggle joint A27 as is the section 34 which is angularly joined to the end portion A24B. While the cuff A24 is not drawn to scale it illustrates one enabling a snug fit of the cuff to be attained without a protuberance.

FIG. 10 illustrates a cuff which is sufficiently similar to those previously shown and accordingly like reference numerals are employed to designate corresponding parts but they are distinguished by the letter prefix "B". In this embodiment a tapering member B20 which is to become a protuberance, the cuff B24 and the toggle joint B27 are joined together when secured to a knee joint channel in a wanted position.

From the foregoing, it will be apparent that with a knee pad attached to a lower leg and with the user in a kneeling position, substantially all the weight that would otherwise be borne by the knee joint is borne by a substantial length of the tibia adjacent the knee joint.

I claim:

1. A knee pad attachable to a lower leg, said knee pad including a flat bottomed support of a length, when so attached and the knee bent with the wearer in a kneeling position, such as to underlie the knee cap and an adjacent portion of the tibia, the upper portion of said support having a concavity for the knee cap and provided with a cushioning layer and including a leg-receiving channel provided with a cushioning layer and inclined away from the surface on which the wearer is kneeling and extending beyond the support and towards the foot of said leg, and means connected to the channel and operable to secure the channel to the leg about the calf, a substantial percentage of the weight of the wearer transmitted to the surface through that part of the support underlying said adjacent portion of the tibia.

2. The knee pad of claim 1 in which the rear end of the support is upwardly curved and when said curved end is in contact with the surface the percentage of the weight of the wearer that is so borne is increased.

3. The knee pad of claim 2 in which the length of the support is such that the junction of the upwardly curved end with the flat surface thereof is approximately midway of the leg.

4. The knee pad of claim 1 in which the free end of at least the cushioning layer of the channel is shaped to engage the instep of the foot and be held thereby to prevent the channel from turning.

5. The knee pad of claim 1 in which the free end of the channel is in the form of a fork shaped and dimensioned to straddle the instep of the foot and inclined forwardly both to enable the foot to be flexed and to hold the channel from turning.

6. The knee pad of claim 5 in which the cushioning layer extends beyond the free end and sides of the channel.

7. The knee pad of claim 1 in which the end of the channel within the support is separated from the knee receiving recess by a transverse shoulder exposed therein and the cushioning layer is of such a thickness in the recess to offset the height of the shoulder.

8. The knee pad of claim 1 in which the upper portion of the support has a rearward seat inclined rearwardly away from the flat bottom thereof and the forward end of the channel is attached to the seat.

9. The knee pad of claim 1 in which the securing means are shaped and dimensioned to fit against the calf downwardly from and including the thickest portion of the calf.

10. The knee pad of claim 1 in which the support includes upper and lower sections interconnected in a manner to enable the support to the flexed with reference to a line transversely intersecting the knee receiving concavity and a flexible layer of a non-slip, non-marring layer is secured to the flat bottom of said upper and lower sections.

11. The knee pad of claim 1 in which at least the lower end of the cushioning layer of the channel is dimensioned to engage the instep area of the shoe on the wearer's foot and the lower end of the channel includes a series of transverse sections centrally interconnected in a manner to enable them to be flexed in response to the flexing of said foot.

12. The knee pad of claim 1 in which the protuberance is a separate part of the knee pad and is attached to the channel in a selected location.

13. The knee pad of claim 12 in which the central part of the cuff is anchored to the protuberance.

14. A knee pad attachable to a lower leg, said knee pad including a cushioned support dimensioned to accommodate the knee when so attached and the wearer is in a kneeling position, said support including a leg-receiving channel provided with a cushioning layer and inclined towards the foot of said leg and away from the surface on which the wearer is kneeling, and a flexible, hard surfaced cuff connected to the channel and having first and second end portions, the first cuff portion shaped and dimensioned to be wrapped about the lower leg and to fit against substantially the entire downwardly tapering portion of the calf, the second cuff portion shaped and dimensioned to be pulled over the first cuff portion to fit the first cuff portion against the calf and then anchored.

15. The knee pad of claim 11 in which the free end of the channel is in the form of a fork shaped and dimensioned to straddle the shoe on the wearer's foot and is outwardly flared to permit the foot to be flexed.

16. The knee pad of claim 14 in which the cushioning layer extends beyond the free end of the channel and is dimensioned to overlie and straddle the instep of the shoe on the wearer's foot.

17. The knee pad of claim 14 in which the channel has an external protuberance adjacent the free end thereof, dimensioned to at least partially offset the thickness of the calf and the first cuff portion overlies the protuberance.

18. The knee pad of claim 14 in which the adjustable cuff includes connecting means having a first part having an end anchored to the exterior of the channel, a toggle joint having a pull strap dimensioned to partially overlie the first section and a second part attached to the second cuff portion adjacent the free end thereof, said second part consisting of a self-closing latch through which, the pull strap is threaded then to be pulled to effect the fitting of the cuff against the leg.

19. The knee pad of claim 14 in which the free end of the first cuff portion has guides spaced to receive the free end of the second cuff portion between them.

* * * * *